United States Patent [19]

Sato

[11] 4,008,662

[45] Feb. 22, 1977

[54] PRINTER RIBBON DRIVE APPARATUS

[75] Inventor: Mitsuhiro Sato, Tokyo, Japan

[73] Assignee: Ricoh Company, Ltd., Tokyo, Japan

[22] Filed: Mar. 10, 1976

[21] Appl. No.: 665,644

[30] Foreign Application Priority Data

Mar. 10, 1975 Japan ..... 50-28080
Mar. 13, 1975 Japan ..... 50-29491

[52] U.S. Cl. ..... 101/336; 101/93.3; 197/151; 197/157

[51] Int. Cl.[2] ..... B41J 35/10; B41F 31/16

[58] Field of Search ..... 101/93.3, 93.31, 93.48, 101/336, 93.15, 93.16, 93.17; 197/151, 154, 157, 158, 166, 167

[56] References Cited

UNITED STATES PATENTS

| | | | |
|---|---|---|---|
| 3,147,703 | 9/1964 | Smithbauer | 101/336 |
| 3,795,185 | 3/1974 | Shimodaira et al. | 101/93.31 |
| 3,832,942 | 9/1974 | Murayoshi | 101/93.31 |
| 3,891,078 | 6/1975 | Jung | 197/151 X |

*Primary Examiner*—Edgar S. Burr
*Assistant Examiner*—Paul T. Sewell
*Attorney, Agent, or Firm*—Frank J. Jordan

[57] ABSTRACT

A hammer is movable to strike paper against a rotatable type member through a ribbon for printing. The hammer is moved for printing by a rotary shaft formed with a projection which engages with the hammer upon rotation of the shaft. A rockable ribbon guide holds the ribbon which has upper and lower portions provided with different colors of ink. A setting lever is pivotally connected to the ribbon guide in such a manner that rocking movement of the setting lever produces rocking movement of the ribbon guide. The setting lever is formed with two engaging portions with which latch members of two solenoids are respectively engagable. A spring urges the setting lever toward a reset position. A first one of the solenoid latch members is arranged to hold the setting lever in a first set position at which one of the colors on the ribbon is in a printing position. Actuation of this first solenoid releases the setting lever so that it is moved by the spring to a second set position at which it is held by a second of the solenoid latch members, the other color of the ribbon being in the printing position. Actuation of this second solenoid releases the setting lever so that it is moved by the spring to the reset position. The projection of the shaft is engagable with the setting lever in the reset position to return the setting lever to the first set position. A ribbon drive shaft is integral with a ratchet, a pawl being reciprocatable to advance the ratchet. A cam fixed to the type member reciprocates the pawl through a rocker linkage to advance the ribbon upon rotation of the type member.

11 Claims, 8 Drawing Figures

PRINTER RIBBON DRIVE APPARATUS

BACKGROUND OF THE INVENTION

1. Field of the Invention

The present invention relates to a ribbon drive apparatus for an impact printer.

In a typical impact printer, a type member is rotatable to select a desired type on the circumference of the type member, and a hammer is moved to strike paper against the type through a ribbon to print the character. It is desirable in devices such as printing electronic calculators to provide a ribbon with two colors of ink to provide emphasis of certain printout. The ribbon is therefore formed so that an upper portion of the ribbon is formed with ink of one color, for example black, and a lower portion of the ribbon is formed with ink of another color, for example red. It is also required to advance the ribbon after a character has been printed.

2. Description of the Prior Art

In prior art devices, complicated and expensive mechanisms comprising a clutch and cam, a plunger or pinion and rack and the like are employed to move a ribbon vertically to select the desired color for printing. Similar mechanisms which further include electric solenoids are used to advance the ribbon after each printing operation. These mechanisms generally have a tendency to move the ribbon by an amount which is just barely sufficient, so that the sharpness of the printed characters is sometimes marginal. The ribbon feed is performed after printing as a separate operation, thereby constituting low efficiency in printing.

SUMMARY OF THE INVENTION

It is an object of the present invention to provide a ribbon drive apparatus for an impact printer which comprises fewer components than prior art apparatus, increases printing speed and also increase the printing clarity.

It is another object of the present invention to provide a ribbon drive apparatus comprising a rockable ribbon guide which is moved from a reset position to a set position by a same rotary shaft formed with a projection which engages with a printing hammer to perform printing.

It is another object of the present invention to provide a ribbon drive apparatus for an impact printer which comprises a ribbon feed pawl operatively reciprocated for ribbon feed by rotation of a type member through a rocker linkage.

The above and other objects, features and advantages of the present invention will become clear from the following detailed description taken with the accompanying drawings.

DESCRIPTION OF THE PREFERRED EMBODIMENTS

Figure 1:
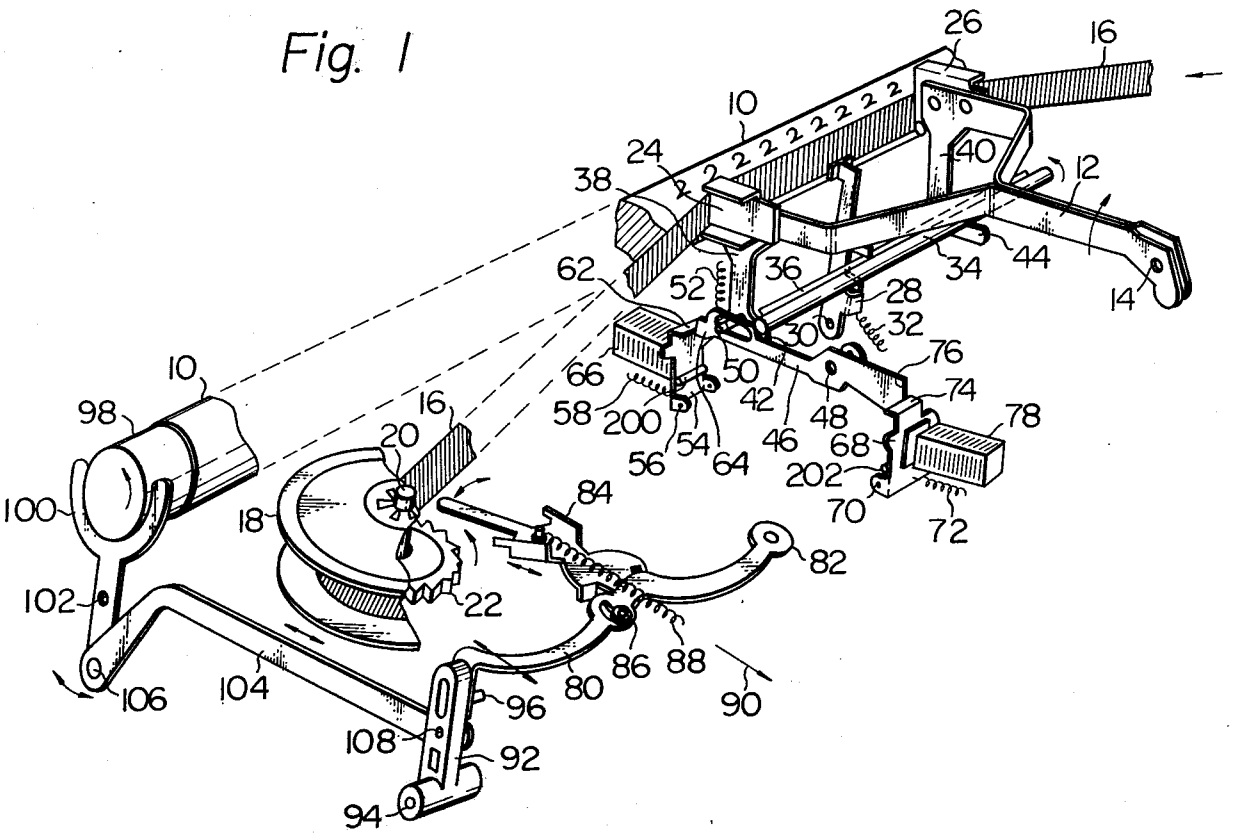
FIG. 1 is a partially exploded perspective view of a ribbon drive apparatus embodying the present invention.

Referring now to FIG. 1, a type drum 10 is rotatable as shown by an arrow. A ribbon guide 12 is rockable about a pivot 14 in front of the type drum 10 and guides a ribbon 16. The ribbon 16 winds around a take-up spool 18 which is fixed to a ribbon drive shaft 20 integral with a drive ratchet 22. The ribbon guide 12 is bifurcated and has two bifurcations 24 and 26 which engage with and guide the ribbon 16.

A printing hammer 28 is pivotal about a point 30 and is urged away from the type drum 10 by a tension spring 32. A rotary shaft 34 is formed with a projection 36 which is engagable with the hammer 28 to accelerate the hammer 28 toward the type drum 10 upon rotation of the shaft 34. Extensions 38 and 40 extend downward from the bifurcations 24 and 26 respectively and terminate in arms 42 and 44 which extend perpendicularly from the extensions 38 and 40. The projection 36 of the shaft 34 is engagable with the arms 42 and 44 as will be described below.

A rockable setting lever 46 is rockable about an intermediate point 48 and is pivotally connected to the extension 38 by a pin 50. A tension spring 52 urges the left end of the setting lever 46 and thereby the ribbon guide 12 upward.

A latch plate 54 is rockable about a pin 56. A tension spring 58 urges the bottom end of the latch plate 54 so that the upper end of the latch plate 54, which is formed with a bent engaging portion 62, is urged toward engagement with a stepped engaging portion 64 formed on the left end of the setting lever 46. A solenoid coil 66 is arranged to attract the engaging portion 62 of the latch plate 54 away from the engaging portion 64 of the setting lever 46 when energized.

A similar latch plate 68 is pivotal about a pin 70 and urged by a spring 72 so that a bent engaging portion 74 of the latch plate 68 is urged toward engagement with an engaging member 76 at the other end of the setting lever 46. Another solenoid coil 78 is arranged to move the engaging portion 74 of the latch plate 68 away from the engaging portion 76 of the setting lever 46 when energized.

A lever 80 is horizontally rockably supported by a pin 82. A pawl 84 is pivotally connected to the lever 80 by a pin 86, and a tension spring 88 urges the pawl 84 as shown by an arrow 90.

A rocker link or lever 92 is vertically rockable about a point 94 and is pivotally connected to the lever 80 by a pin 96. A cam 98 in the form of an eccentric is fixed for rotation with the type drum 10. A bifurcated end of a cam follower rocker link or lever 100 operatively engages with the cam 98. The lever 100 is rockable about an intermediate point 102. A connecting lever 104 is pivotally connected to a lower end of the lever 100 by a pin 106 and to an intermediated point of the lever 92 by a pin 108.

Figure 2A:
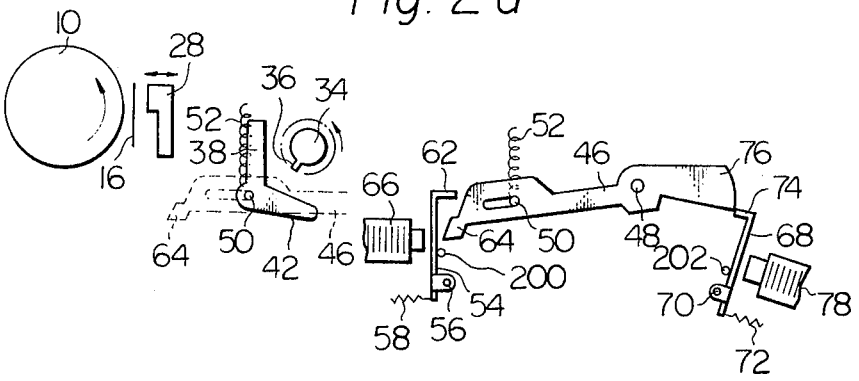
FIG. 2*a* is a partially exploded perspective view of part of the apparatus in a first set position.
Figure 2B:
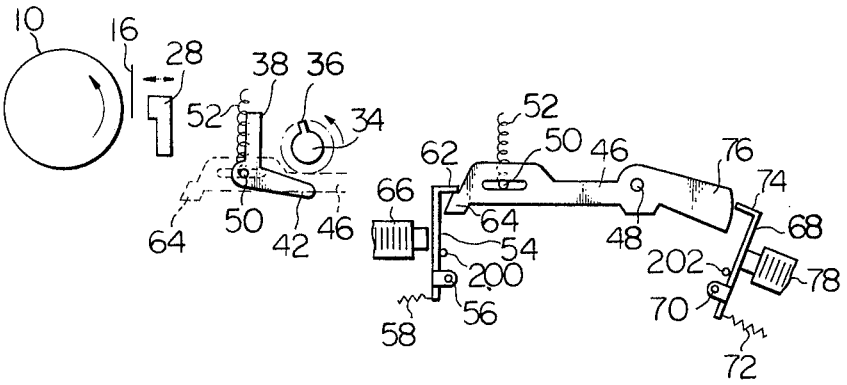
FIG. 2*b* is similar to FIG. 2*a* but shows a second set position.

The operation of a color selecting portion of the ribbon drive apparatus will now be described with reference to FIGS. 2*a* to 2*c*. In FIG. 2*a*, the setting lever 46 is held in its most counterclockwise position against the force of the spring 52 by the engaging portion 74 of the latch plate 68 which is disposed under the engaging portion 76 of the setting lever 46. The latch plate 68 is held in abutment against a stop 202 in the position shown by the spring 72. The engaging portion 62 of the latch plate 54 is disposed above the engaging portion 64 of the setting lever 46 in this position, with the latch plate 54 being urged into abutment against a stop 200 by the spring 58. As shown in FIG. 2*a*, the ribbon guide 12 and thereby the ribbon 16 are rocked to a most downward or first set position by means of the pin 50 and extension 38, so that the top portion (provided with, for example, black ink) of the ribbon 16 is operatively disposed in a printing position adjacent to the hammer 28. The projection 36 of the shaft 34 will not engage with the arms 42 and 44 in this position. If it is desired to print with red ink, a signal is momentarily fed from a control unit (not shown) to energize the solenoid coil 78, which attracts the latch plate 68 for clockwise rotation to release the setting lever 46. The setting lever, 46, thus released, rotates clockwise about the pin 48 until it is stopped by abutment of the engaging portion 64 of the setting lever 46 against the bent engaging portion 62 of the latch plate 54. This condition is shown in Fig. 2*b*. In this manner, the ribbon guide 12 is rocked upward by the pin 50 and extension 38 so that the lower portion (provided with, for example, red ink) of the ribbon 16 is disposed in the printing position adjacent to the hammer 28. This is designated as a second set position of the ribbon guide 12 and setting lever 46, and the projection 36 of the shaft 34 is not engagable with the arms 42 and 44 in this position.

To print a character with the ribbon drive apparatus in either of the positions shown in FIGS. 2*a* and 2*b*, the shaft 34 is rotated as shown by arrows so that the projection 36 engages with the hammer 28 and accelerates the same toward the type drum 10. The control unit actuates the shaft 34 when a desired type on the type drum 10 is adjacent to the hammer 28. The hammer 28 travels due to inertia into contact with a sheet of paper (not shown), and continues to strike the paper against the type drum 10 with the ribbon 16 interspersed between the paper and the type drum 10. The hammer 28 is returned to the position shown in FIG. 1 after printing by means of the spring 32.

After the hammer 28 strikes the ribbon 16 and starts to return to its rest position, the control unit energizes the solenoid coil 66 which attracts the latch plate 54 away from the setting lever 46 so that the engaging portion 64 of the setting lever 46 is no longer engagable with the engaging portion 62 of the latch member 54. The setting lever 46 is thereby rotated clockwise by the spring 52 to the reset position shown in FIG. 2*c* in which the projection 36 of the shaft 34 is engagable with the arms 42 and 44 of the ribbon guide 12. When the projection 36 engages with the arms 42 and 44, the setting lever 46 is rotated counterclockwise and the ribbon guide 12 is rocked downward to the position of FIG. 2*a* in preparation for another printing operation.

Figure 2C:
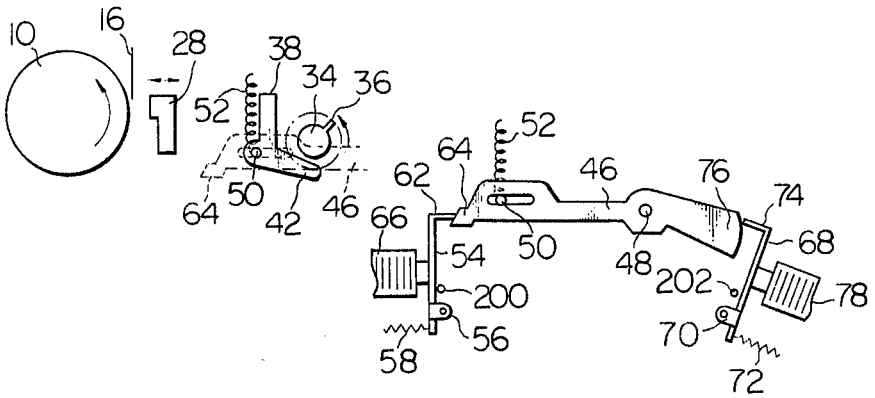
FIG. 2*c* is similar to FIG. 1 but shows a reset position.
Figure 3:
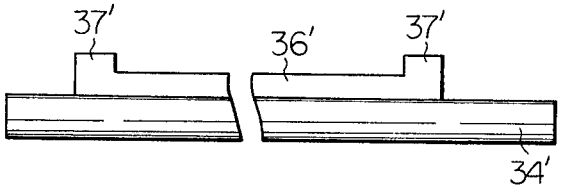
FIG. 3 is an overhead view of a modification of a shaft of the present apparatus.

In the embodiment shown, the projection 36 of the shaft 34 is arranged to accelerate the setting lever 46 and ribbon guide 12 so that they will move by means of inertia to the position of FIG. 2*a* from the position of FIG. 2*c* in which the setting lever 46 will be latched by the engaging portion 74 of the latch plate 68. A modification of the projection 36 is shown in FIg. 3, in which a shaft 34′ is formed with a projection 36′ which accelerates the hammer 28. Longer projections 37′ are provided to engage with the arms 42 and 44 and accelerate the more massive setting lever 46 and ribbon guide 12 to a greater extent. The projections 37′ may be replaced by cams (not shown) if desired.

Referring now to FIG. 1, the operation of a ribbon advancing portion of the ribbon drive apparatus will be described.

The lever 80 is rockable left and right as shown by an arrow to advance the ratchet 22. Specifically, when the lever 80 is moved leftward, the pawl 84 engages with a tooth of the ratchet 22 to advance the ratchet 22 and thereby the ribbon 16 by one step. When the lever 80 is moved rightward, the pawl 84 is moved to the disengaged position shown in FIG. 1 in preparation for another advancing operation. The pivotal connection of the pawl 84 to the lever 80 by means of the pin 86 and the action of the spring 88 allows the pawl 84 to ride backward over the top of the next tooth of the ratchet 22 in a yielding manner.

A linkage to reciprocate the lever 80 left and right to advance the ribbon 16 comprises the lever 100. Rotation of the eccentric cam 98 integral with the type drum 10 causes the lever 100 to reciprocatingly rock about the point 102. This rocking movement is transmitted to the lever 92 through the connecting link 104 to cause the lever 92 to rock back and forth about the point 94. The rocking movement of the lever 92 is transmitted to the lever 80 by the pivotal connection provided by the pin 96. The ratchet 22 and thereby the ribbon 16 will thereby be advanced by one step for each rotation of the type drum 10.

Figure 4:
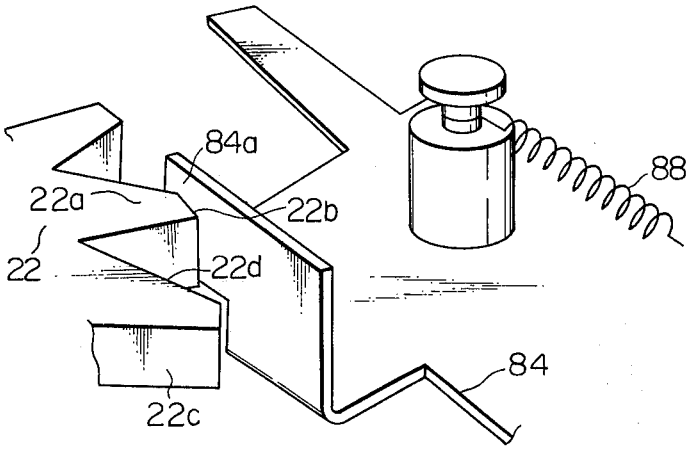
FIG. 4 is an enlarged perspective view of a ratchet and pawl of the present apparatus.

Referring now to FIG. 4, during rightward movement of the lever 80 toward the position shown in FIG. 1 after a ribbon advancing operation, an engaging portion 84*a* of the pawl 84 rides over a top 22*b* of a tooth 22*a* of the ratchet 22 and impacts against a side portion 22*d* of a next tooth 22*c* due to the action of the spring 88. Means to prevent the generation of excessive noise by this action are illustrated in FIGS. 5 and 6.

Figure 5:
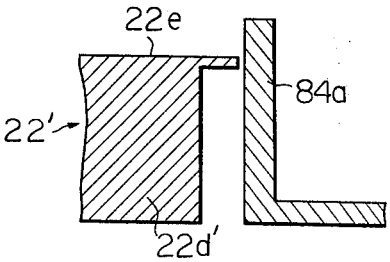
FIG. 5 is an enlarged view of a modified tooth of the ratchet shown in FIG. 4.
Figure 6:
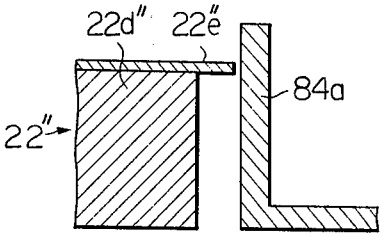
FIG. 6 is an enlarged view of another modified tooth of the ratchet.

A shown in FIG. 5, a tooth portion 22*d′* of a ratchet 22′ with which the pawl engaging member 84*a* abuts upon retraction of the pawl 84 is provided with a coating 22*e* of a low hardness material such as polyurethane or nylon to damp the impact and eliminate excessive noise. The engaging portion 84*a* may similarly be formed of such a material. In FIG. 6, a corresponding tooth portion 22*d″* of ratchet 22″ is provided with an insert 22*e″* made of a low hardness material.

What is claimed is:

1. A printer ribbon drive apparatus, comprising:

a rotatable type member;

a rockable ribbon guide;

a rockable setting lever connected to the ribbon guide so that rocking movement of the setting lever produces rocking movement of the ribbon guide, the setting lever and ribbon guide being rockable from a first set position through a second set position to a reset position;

a spring urging the setting lever and ribbon guide to the reset position;

a first releasable latch to hold the setting lever in the first set position;

a second releasable latch to hold the setting lever in the second set position;

a printing hammer;

a rotary shaft formed with a hammer actuating projection to engage with the printing hammer upon rotation of the shaft to move the printing hammer toward the type member; and a setting projection formed on the shaft to engage with the ribbon guide in the reset position upon rotation of the shaft and move the ribbon guide and setting lever to the first set position;

2. The apparatus of claim 1, in which the setting lever is rotatably supported at an intermediate point and is pivotally connected to the ribbon guide, the setting lever being formed with engaging portions at the opposite ends thereof, the first releasable latch being engagable with one of the engaging portions and the second releasable latch being engagable with the other of the engaging portions.

3. The apparatus of claim 1, in which the first and second releasable latches comprise solenoids respectively having movable engaging members respectively engagable with the engaging portions of the setting lever.

4. The apparatus of claim 1, in which the ribbon guide is formed with a bifurcated ribbon holding end, the setting lever being pivotally connected to one of the bifurcations of the bifurcated end.

5. The apparatus of claim 1, further comprising a ribbon drive ratchet;

a pawl reciprocatable to advance the ratchet;

a cam fixed for rotation with the type member;

a cam follower engaging with the cam; and a linkage connecting the cam follower to the pawl so that rotation of the cam produces reciprocating movement of the pawl.

6. The apparatus of claim 5, in which the linkage comprises a rocker lever pivotally connected to the pawl.

7. The apparatus of claim 6, in which the linkage further comprises a connecting link connecting the cam follower to the rocker lever.

8. The apparatus of claim 7, in which the cam follower comprises a rocker link connected to the connecting link.

9. The apparatus of claim 8, in which the cam comprises an eccentric member fixed for rotation with the type member and the rocker link of the cam follower is formed with a bifurcated end engaging with the eccentric member.

10. The apparatus of claim 9, in which the rocker link of the cam follower is rockable about an intermediate point, an end opposite to the bifurcated end being pivotally connected to the connecting link.

11. The apparatus of claim 5, further comprising an impact absorbing coating formed on teeth of the ratchet.

* * * * *